United States Patent [19]

Koo et al.

[11] 4,067,756

[45] Jan. 10, 1978

[54] HIGH STRENGTH, HIGH DUCTILITY LOW CARBON STEEL

[75] Inventors: Jayoung Koo; Gareth Thomas, both of Berkeley, Calif.

[73] Assignee: The United States of America as represented by the United States Department of Energy, Washington, D.C.

[21] Appl. No.: 737,753

[22] Filed: Nov. 2, 1976

[51] Int. Cl.[2] ..... C21D 1/78; C22C 38/02

[52] U.S. Cl. ..... 148/144; 75/123 L; 148/36; 148/143

[58] Field of Search ..... 75/123 L; 148/12 R, 148/36, 112, 134, 143, 144, 12.4

[56] References Cited

U.S. PATENT DOCUMENTS

| | | | |
|---|---|---|---|
| 1,733,669 | 10/1929 | Makita et al. | 148/134 |
| 2,097,878 | 11/1937 | Grabe | 148/143 |
| 2,618,843 | 11/1952 | Goodsell | 75/123 L |
| 2,664,369 | 12/1953 | Kiefer | 148/143 X |
| 2,779,698 | 1/1957 | Baughman et al. | 148/143 |
| 3,278,345 | 10/1966 | Grange et al. | 148/143 X |
| 3,288,657 | 11/1966 | Morito et al. | 148/143 |
| 3,423,252 | 1/1969 | Grange | 148/12 |
| 3,502,514 | 3/1970 | Grange | 148/12.4 |
| 3,936,324 | 2/1976 | Uchida et al. | 148/134 X |

FOREIGN PATENT DOCUMENTS

| | | | |
|---|---|---|---|
| 655,315 | 1965 | Belgium | 75/123 L |
| 1,091,942 | 1967 | United Kingdom | 148/12.4 |

*Primary Examiner*—C. Lovell

*Attorney, Agent, or Firm*—Dean E. Carlson; Roger S. Gaither; Irene S. Croft

[57] ABSTRACT

A high strength, high ductility low carbon steel consisting essentially of iron, 0.05–0.15 wt% carbon, and 1–3 wt% silicon. Minor amounts of other constituents may be present. The steel is characterized by a duplex ferrite-martensite microstructure in a fibrous morphology. The microstructure is developed by heat treatment consisting of initial austenitizing treatment followed by annealing in the ($\alpha + \gamma$) range with intermediate quenching.

12 Claims, 6 Drawing Figures

HIGH STRENGTH, HIGH DUCTILITY LOW CARBON STEEL

BACKGROUND OF THE INVENTION

The invention described herein was made in the course of or under Energy Research and Development Administration Contract No. W-7405-ENG-48 with the University of California.

The present invention relates to a high strength, high ductility low carbon steel, more particularly, a steel characterized by a duplex ferrite-martensite structure in a fibrous morphology.

High strength steel is generally intended for applications where savings in weight can be effected by reason of its greater strength and better durability. To be of interest as commercial materials, high strength steels must have sufficient ductility and formability to be successfully fabricated by customary shop methods. The two main methods which have been used to obtain steels combining high strength with adequate ductility have been careful choice of alloying elements and skillful manipulation of thermal and/or mechanical processing.

A specific group of steels with chemical composition specifically developed to impart higher mechanical property values is known in the art as high-strength low-alloy (HSLA) steel. These steels contain carbon as a strengthening element in an amount reasonably consistent with weldability and ductility. Various levels and types of relatively expensive alloy carbide formers are added to achieve the mechanical properties which characterize these steels.

More recently, it has been recognized that a fibrous martensite-ferrite mixture is a type of microstructure having a useful combination of mechanical properties. However, the prior art processes for developing such a microstructure have involved both thermal and mechanical treatment. Such processing methods are described, for example, in Grange, U.S. Pat. No. 3,423,252, issued Jan. 21, 1969 for "Thermomechanical Treatment of Steel"; Grange, U.S. Pat. No. 3,502,514, issued March 24, 1970 for "Method of Processing Steel"; and Charles et al, British Pat. No. 1,091,942, published November 22, 1967 for "Improvements in and Relating to Fibre Strengthened Materials".

The need exists for a high strength, high ductility steel of relatively simple composition and requiring relatively simple processing.

SUMMARY OF THE INVENTION

The present invention is a high strength low carbon steel containing from about 1 to about 3 wt% silicon. More particularly, the present low carbon steel is characterized by a duplex ferrite-martensite microstructure in a fibrous morphology. This microstructure is developed by simple heat treatment comprising an initial austenitizing treatment followed by annealing in the $(\alpha+\gamma)$ range with intermediate quenching.

It is, therefore, an object of this invention to provide an improved high strength low carbon steel.

It is a further object of the invention to provide a high strength low carbon steel having a controlled martensite-ferrite microstructure, which in turn offers a wide range of strength and ductility combinations.

A further object of this invention is to provide a high strength low carbon steel which can be produced substantially solely by simple heat treatment.

Other objects and advantages will become apparent from the following detailed description made with reference to the accompanying drawings.

DETAILED DESCRIPTION OF THE INVENTION

Figure 1A:
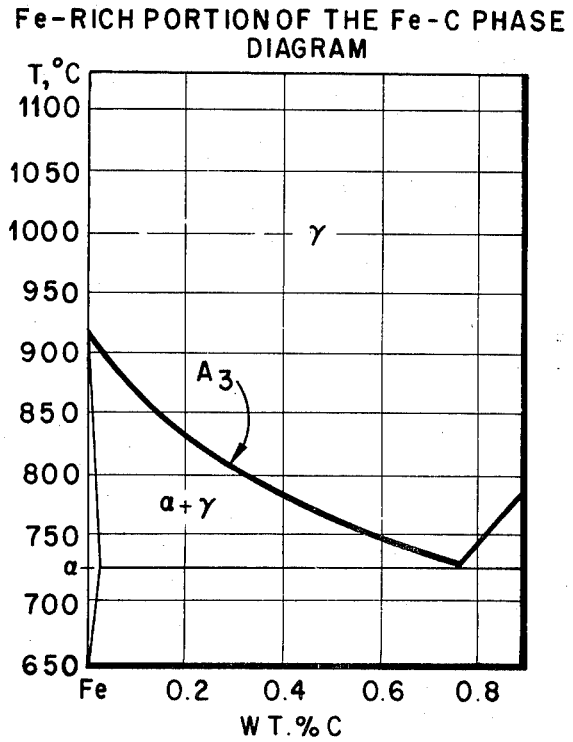
FIG. 1*a* is the Fe-rich portion of the Fe-C phase diagram.

Broadly, the present invention is a high strength, high ductility low carbon steel comprising iron, from about 0.05 to about 0.15 wt% carbon and from about 1 to about 3 wt% silicon. Preferably, the amount of carbon present is of the order of about 0.1 wt% and the amount of silicon present is of the order of about 2 wt%.

The steel of the present invention is characterized by a unique microstructure which is a fine, isotropic, acicular martensite in a ductile ferrite matrix, due to a combination of heat treatment as hereinafter described and the presence of silicon in the above-specified amount. According to the theory of discontinuous fiber composite, this unique microstructure maximizes the potential ductility of the soft phase ferrite and also fully exploits the strong martensite phase as a load carrying constituent in the duplex microstructure.

Preferably, the present steel consists essentially of iron, carbon and silicon. Trace amounts, up to a combined total of about 0.5 – 1 wt%, of other conventional alloying elements may be present provided such additives do not significantly alter the microstructure and, hence, the mechanical properties, of the steel. In particular, minor amounts of manganese, of the order of about 0.5 wt%, may be present.

The factors governing the properties of carbon steel are primarily its carbon content and microstructure and secondarily the residual alloy. The microstructure is determined largely by the composition and the final operations, such as rolling, forging, and/or heat treating operations. Normally, steel in the as-received condition (cast, rolled, or forged) is predominantly pearlitic. Further processing is required to develop particular microstructural changes for particular combinations of properties.

As stated above, the unique microstructure of the present low carbon steel which is responsible for its high strength and high ductility properties is developed by a combination of heat processing and silicon content as above-specified. The heat treatment comprises simply an initial austenitizing treatment, that is, heating at a temperature ($T_1$) above the critical temperature ($A_3$) at which austenite forms for a period of time sufficient to substantially completely austenitize the steel, followed by quenching in order to transform the austenite to martensite, and then annealing at a temperature ($T_2$) in the ($\alpha+\gamma$) range. By holding in the two phase range, the $\alpha$ and $\gamma$ phases attain the composition specified by the tie line corresponding to the holding temperature. The alloy then consists of low carbon ferrite and higher carbon austenite. Upon final quenching, the austenite transforms to martensite (strong phase), and the soft phase ferrite becomes heavily dislocated due to the $\alpha\rightarrow$ martensite transformation strain. This feature is revealed only by transmission electron microscopy. The result is a strong martensite phase in a ductile ferrite matrix. During quenching from the two phase ($\alpha+\gamma$) range, undesirable carbide formation in the immediate vicinity of $\alpha$/prior $\gamma$ boundaries due to low hardenability is inhibited because of the unique role of the Si.

The brittle phase carbides, which are present in other duplex Fe-0.1C-X alloys, are undesirable because according to the theory of discontinuous fiber composite, strengthening occurs by shear action along the $\alpha$/martensite interfaces and the maximum stress concentration occurs near the interfaces so that a crack in one of these brittle phase carbides during the early stage of deformation can cause premature failure in duplex structures.

The fraction of martensite present in the final product can be controlled by the annealing temperature in the ($\alpha+\gamma$) range, and hence a wide range of strength and elongation ductility combinations are obtained (see FIG. 4), but the preferred range for optimum properties is 20 - 50 vol. % of martensite.

Figure 1B:
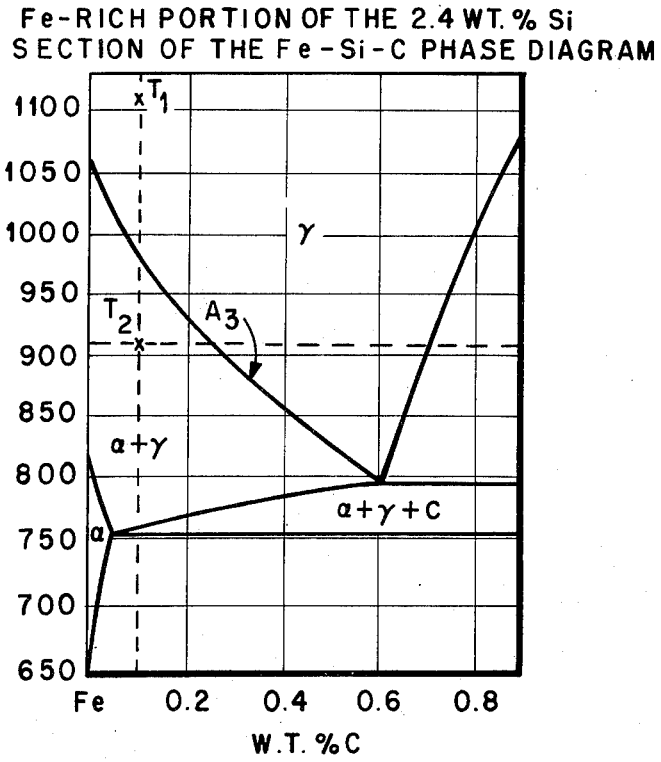
FIG. 1*b* is the Fe-rich portion of the 2.4 wt% Si section of the Fe-Si-C phase diagram.

The above-described heat treatment will be better understood by reference to FIG. 1*b* which is the Fe-rich portion of the phase diagram of the Fe-Si-C system containing specifically 2.4 wt% silicon. Referring to FIG. 1*b*, the datum point labeled $T_1$ is above the critical temperature $A_3$ so that heating an Fe-0.1C2.4Si alloy at temperature $T_1$ will completely austenitize the steel. After quenching, the steel can then be annealed at temperature $T_2$ which is in the ($\alpha+\gamma$) range. The tie line corresponding to $T_2$ specifies the compositions attained by the $\alpha$ and $\gamma$ phases as a result of the annealing process.

In general, for the present duplex steel containing carbon and silicon in the amounts specified above, initial austenitizing is accomplished by heating the steel composition to a temperature ($T_1$) in the range of about 1050–1170° C for a period of about 10 to 60 minutes. Following a rapid quench to room temperature, annealing is accomplished by heating the composition at a temperature ($T_2$) in the range of about 800°–1000° C for a period of about 3 to 30 minutes. The annealing treatment is then followed by rapid quenching to room temperature.

The following example is illustrative of the present invention.

EXAMPLE

Figure 2:
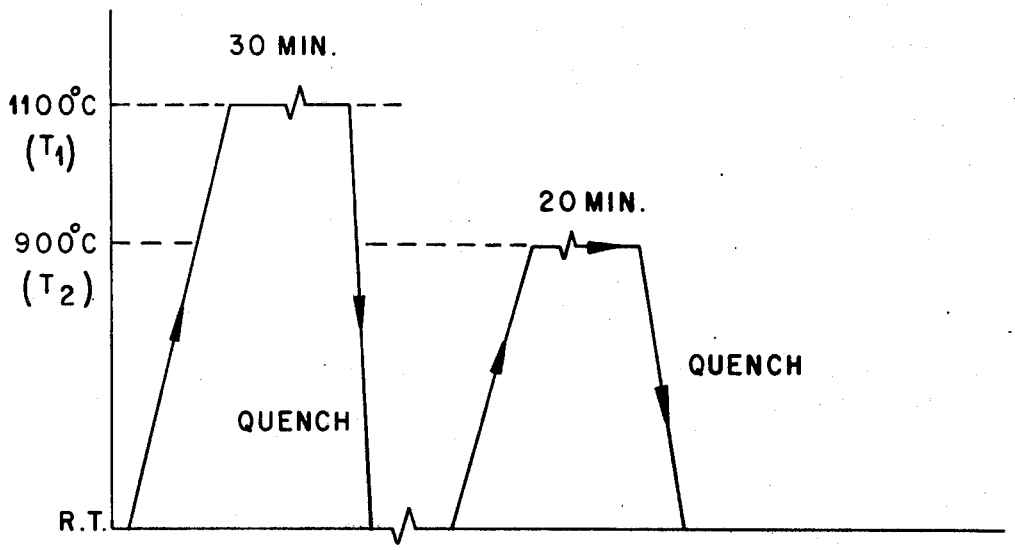
FIG. 2 is a diagrammatic representation of the principle of heat treatment to produce fibrous martensite in Fe-0.1C–2Si steel.
Figure 3A:
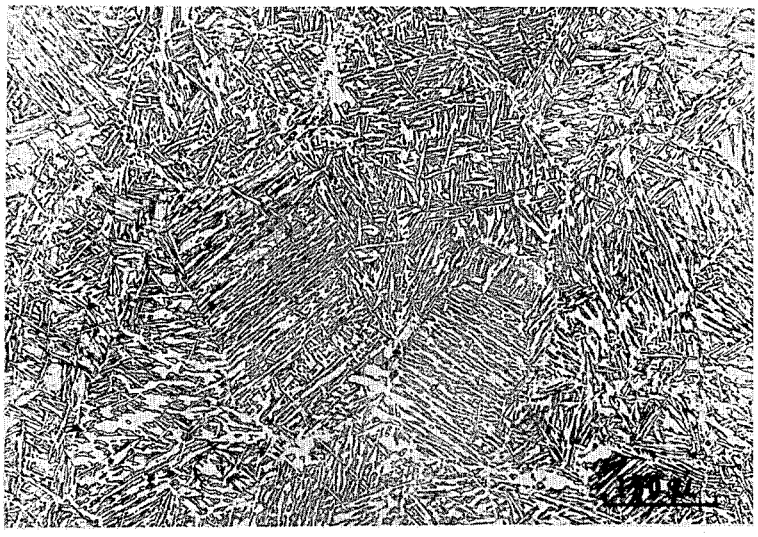
FIG. 3*a* is an optical micrograph showing needle-shaped duplex microstructure developed in Fe-0.1C–2-Si alloy.
Figure 3B:
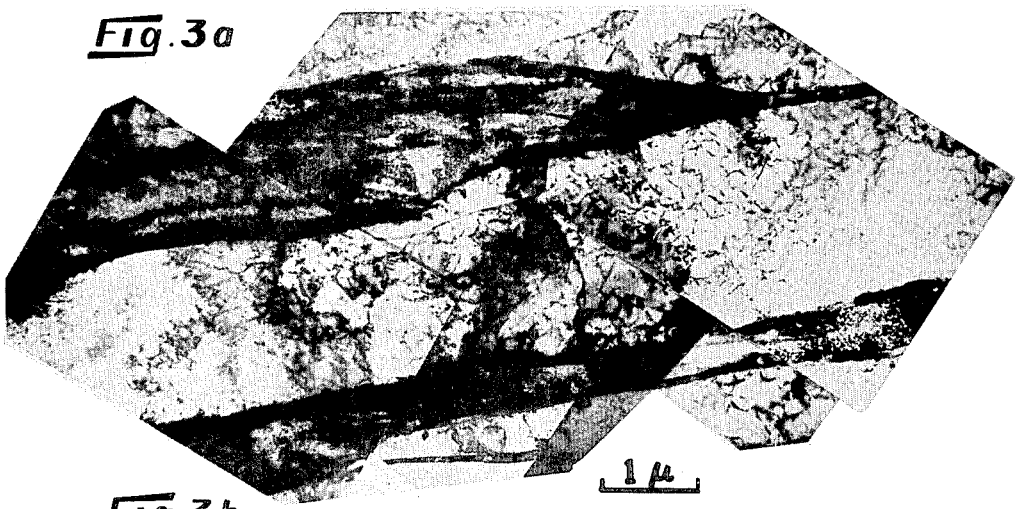
FIG. 3*b* is a transmission electron micrograph showing a magnified view of the individual needles in 3*a* surrounded by dislocated ferrite.

A steel composition consisting essentially of iron, 2 wt% silicon, and 0.065 wt% carbon (as determined by carbon analysis) was processed by the heat treatment represented diagrammatically in FIG. 2. Referring to FIG. 2, the composition was first heated at a temperature of about 110° C for about 30 minutes to completely transform the composition to the austenite phase. The allow was then rapidly water quenched to room temperature to produce substantially 100% martensite. The composition was then heated to about 900° C and maintained at that temperature for about 20 minutes, followed by a final quench to room temperature. The final product contained 35–40% martensite. The microstructure of the product was a fine, isotropic, acicular martensite in a ductile ferrite matrix as shown in the photographs of FIG. 3*a* and FIG. 3*b*. As is conventional in the art, the percentage amount of carbon in steel is normally rounded off; hence, the resulting steel is referred to as Fe-0.1C-2Si steel.

Figure 4:
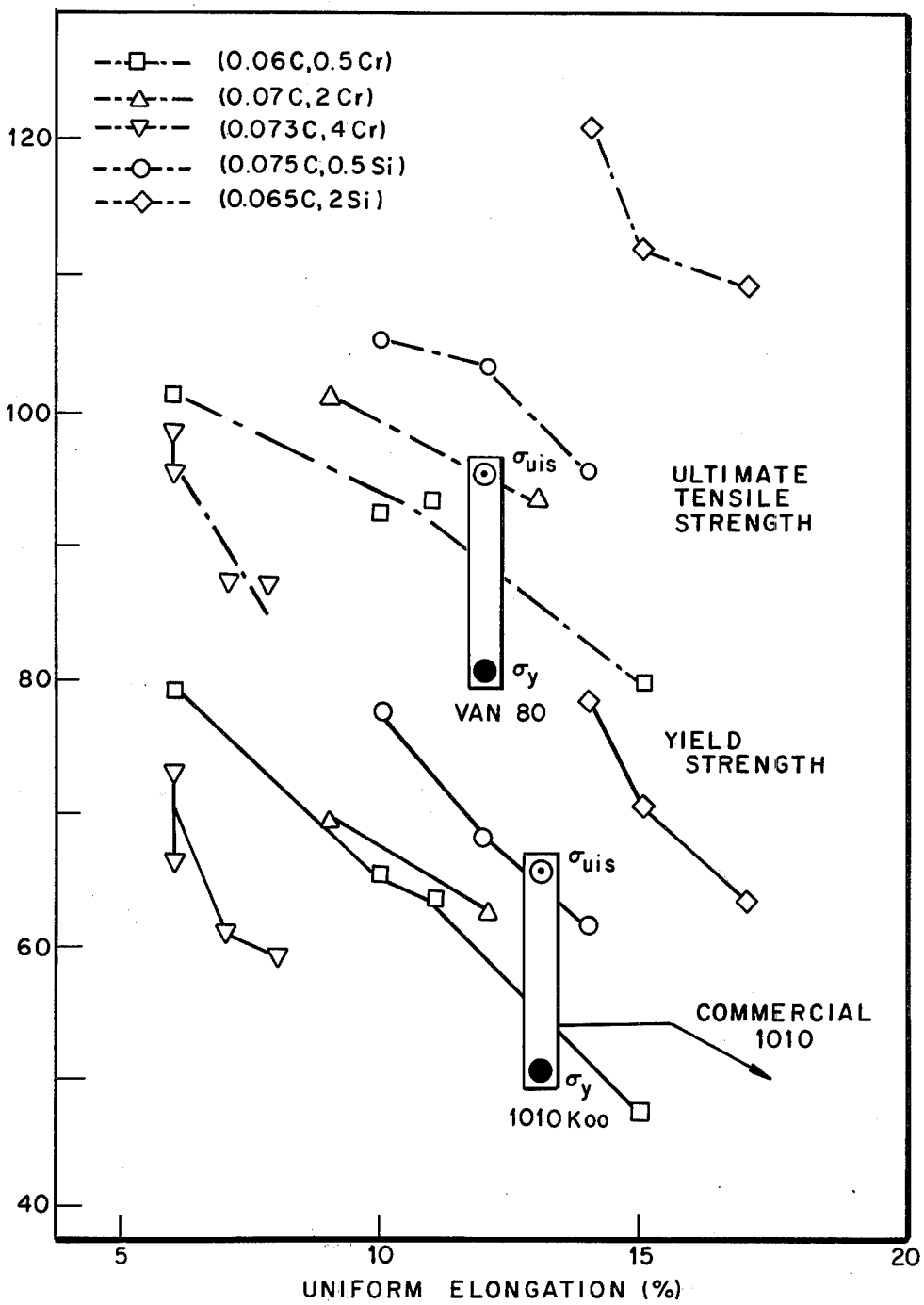
FIG. 4 is a graph illustrating the tensile properties of Fe-0.1C-2Si steel in comparison with other Fe-0.1C-X alloys, X being varying amounts of Cr and Si, and with Van 80 (a commercial steel), commercial 1010 steel and a modified 1010 steel.
Figure 5:
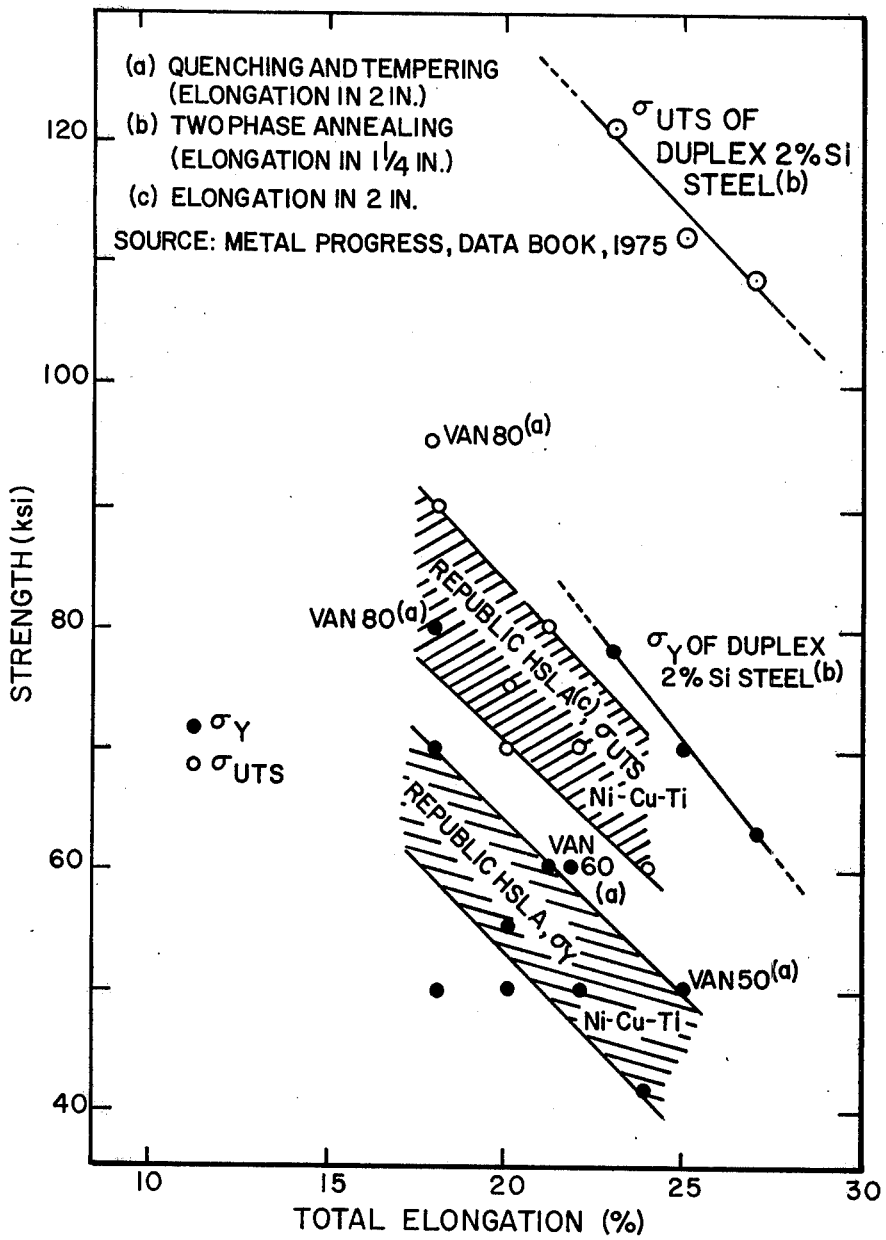
FIG. 5 is a graph illustrating the tensile properties of Fe-0.1C-2Si steel in comparison with those of selective commercial HSLA steels.

The tensile properties of the resulting steel were determined and are shown in FIG. 4 and FIG. 5.

FIG. 4 graphically illustrates the ultimate tensile strength ($\sigma_{uts}$) and the yield strength ($\sigma_y$) of the steel obtained above in comparison with other ferritic-martensitic Fe-C-X steels, X being Cr or Si, namely, Fe-0.06C-0.5Cr; Fe-0.07C-2Cr; Fe-0.073C-4Cr; and Fe-0.075C-0.5Si. Also shown for comparison are the tensile properties of Van 80, a commercial HSLA steel produced by Jones and Laughlin Steel Company, and of $1010_{Koo}$ which refers to a commercial 1010 steel modified by the above-described heat treatment but without addition of silicon (J-Y Koo and G. Thomas, Materials Science and Engineering, 24, 187, 1976). As indicated by the arrow labeled Commercial 1010, the tensile product properties of commerical 1010 steel are below the limits of the graph.

FIG. 5 graphically illustrates the tensile properties of the above-obtained steel (referred to as "duplex 2% Si steel") in comparison with those of selective commercial HSLA steels, namely, Van 50, Van 60, and Van 80 (products of Jones and Laughlin Steel Company) Republic HSLA steels and a commercial Ni-Cu-Ti steel.

It can be seen from FIG. 4 and FIG. 5 that the 2%Si duplex steel of the present invention exhibited superior strength and elongation ductility combinations than the other steels shown. This combination of properties was better than that of Van 80 which is considered to be one of the best available HSLA steels. In particular, very high ultimate tensile strength of the 2%Si duplex steel is extremely attractive for industrial purpose in terms of good uniform formability.

In view of obtaining desirable macro- and microstructural features, which in turn provide desirable mechanical properties, the presence of silicon has a unique beneficial effect on the production of the ferritic-martensitic structure. Silicon has further advantages from a practical point of view: (1) Silicon is one of the alloying elements which open up the ($\alpha+\gamma$) range when added to the Fe-C system (compare the phase diagram of FIG. 1*b* with the phase diagram of FIG. 1A) so that a wide temperature range is available for the second part of the heat treatment, thereby insuring reproducibility of results. (2) The fundamental advantages of silicon as an alloying element are that it is inexpensive and readily available. (3) Silicon is a very effective solid-solution strengthener.

The mechanical properties achieved from the steel of the present invention exceed the industrial goals for HSLA steels (total elongation requirement 18% or more, 2% offset - 68 ksi, and final strength - 80 ksi) without the necessity of normal tempering practice.

The present duplex steel has particular advantages for the automotive/pipeline industries. An estimate of weight and fuel savings can be made, based on the following data from the article by D. G. Younger, Manager, Advanced Safety Car Department, Ford Motor Company, Lavonia, Mich. The ranges of weight savings gained by substituting HSLA steels for the current 30,000 psi yield steels are tabulated in Table 1.

TABLE 1

| Weight Savings Potential of HSLA Steels | |
|---|---|
| Yield Strength | Range of Potential Weight Savings (%) |
| 50,000 psi | 22.5 to 40 |
| 60,000 psi | 29 to 50 |
| 70,000 psi | 34 to 57.1 |
| 80,000 psi | 38.8 to 62.5 |

Table 2 shows the approximate direct worth of a 100 lb. weight reduction on fuel economy and performance.

TABLE 2

| EFFECT OF 100 LB. WEIGHT REDUCTION | | |
|---|---|---|
| | Small/ Compact Cars | Intermediate/ Luxury Cars |
| Fuel Economy Effect | + 0.5 mpg | + 0.2 mpg |
| 0 - 10 sec. Performance Effect | + 14 feet | + 7 feet |

A rule-of-thumb can be applied as follows (according to the above-cited article): Strength-critical parts offer excellent opportunities for weight savings which, on the average, can be 30 percent of the current weight if fredom to generate new designs is permitted.

Consider then a compact car weighing about 3,000 lb. From Table 1, weight savings gained at $\sigma_y \sim 70{,}000$ psi would be about 45%, i.e. $3000 \times 0.45 \times 0.3 \simeq 400$ lb. That is, 400 lb. weight savings can be gained if the strength-critical parts are substituted by HSLA steels of 70,000 psi yield strength. The effect of 400 lb. weight reduction on the fuel economy effect is not readily estimated by using Table 2, since fuel economy effect is not a linear function with weight reduction beyond 100 lb. However, it is clear that savings in material in fuel are possible by the use of the present steel in the automotive/pipeline industries.

It is to be emphasized that the present silicon-containing duplex steel is inexpensive to manufacture, both because the production method requires no mechanical treatment, such as hot or cold rolling, and because the constituents are inexpensive - carbon and silicon as opposed to, for example, expensive nickel or chromium. From the standpoint of superior properties and simplicity in composition and heat treatment, the present silicon-containing duplex steel has considerable utility.

Although the invention has been described with respect to specific examples, it is to be understood that various other embodiments and modifications will be obvious to those skilled in the art, and it is not intended to limit the invention except by the terms of the following claims.

What we claim is:

1. A method for producing a high strength, high ductility steel characterized by a duplex ferrite-martensite microstructure in a fibrous morphology which comprises:

heating a steel composition consisting essentially of iron, from about 0.05 to about 0.15 wt% carbon and from about 1 to about 3 wt% silicon at a temperature, $T_1$, above the critical temperature at which austenite forms for a period of time to substantially completely austenitize the steel;

quenching the resulting austenitic composition to substantially completely transform the austenite to martensite;

heating the resulting martensitic composition at a temperature, $T_2$, in the $(\alpha+\gamma)$ range for a period of time sufficient to transform the martensite to a mixture of ferrite and austenite; and quenching the resulting ferritic-austenitic composition to transform the austenite to martensite;

thereby developing said duplex ferrite-martensite microstructure in a fibrous morphology.

2. A method according to claim 1 wherein $T_1$ is in the range from about 1050° C to about 1170° C and $T_2$ is in the range from about 800° C to about 1000° C.

3. A method according to claim 1 wherein the silicon content of the steel composition is about 2 wt%.

4. A method according to claim 1 wherein the martensitic composition is heated in the $(\alpha+\gamma)$ range under conditions to provide a mixture of ferrite and austenite such that the subsequent quenching step results in a microstructure containing 20 - 50 volume percent martensite.

5. A high strength, high ductility steel composition consisting essentially of iron, from about 0.05 to about 0.15 wt% carbon, and from about 1 to 3 wt% silicon and characterized by a duplex ferrite-martensite microstructure in a fibrous morphology.

6. A composition according to claim 5 wherein said microstructure contains 20 - 50 volume percent martensite.

7. A composition according to claim 5 wherein said microstructure is developed by a heat treatment process comprising:

heating said composition at a temperature, $T_1$, above the critical temperature at which austenite forms for a period of time sufficient to substantially completely austenitize the steel;

quenching the resulting austenitic composition to substantially completely transform the austenite to martensite;

heating the resulting martensitic composition at a temperature, $T_2$, in the $(\alpha+\gamma)$ range for a period of time sufficient to transform the martensite to a mixture of ferrite and austenite; and quenching the resulting ferritic-austenitic composition to transform the austenite to martensite.

8. A composition according to claim 7 wherein $T_1$ is in the range from about 1050° C to about 1170° C and $T_2$ is in the range from about 800° C to about 1000° C.

9. A high strength, high ductility steel composition consisting essentially of iron, from about 0.05 to about 0.15 wt% carbon, and about 2 wt% silicon and characterized by a duplex ferrite-martensite microstructure in a fibrous morphology.

10. A composition according to claim 9 wherein said microstructure contains 20 - 50 volume percent martensite.

11. A composition according to claim 9 wherein said microstructure is developed by a heat treatment process comprising:

heating said composition at a temperature, $T_1$, above the critical temperature at which austenite forms for a period of time sufficient to substantially completely austenitize the steel;

quenching the resulting austenitic composition to substantially completely transform the austenite to martensite;

heating the resulting martensitic composition at a temperature, $T_2$, in the $(\alpha+\gamma)$ range for a period of time sufficient to transform the martensite to a mixture of ferrite and austenite; and quenching the resulting ferritic-austenitic composition to transform the austenite to martensite.

12. A composition according to claim 11 wherein $T_1$ is in the range from about 1050° C to about 1170° C and $T_2$ is in the range from about 800° C to about 1000° C.

* * * * *